US005427019A

United States Patent [19]

Moorman

[11] Patent Number: 5,427,019

[45] Date of Patent: Jun. 27, 1995

[54] SHEET MATERIAL PALLET WITH WRAP AROUND DECK

[75] Inventor: Stephen E. Moorman, Bowling Green, Ohio

[73] Assignee: Georgia-Pacific Corporation, Atlanta, Ga.

[21] Appl. No.: 955,066

[22] Filed: Oct. 1, 1992

Related U.S. Application Data

[63] Continuation-in-part of Ser. No. 772,661, Oct. 7, 1991, Pat. No. 5,337,679.

[51] Int. Cl.[6] ..... B65D 19/00

[52] U.S. Cl. ..... 108/51.3; 108/56.1

[58] Field of Search ..... 108/51.1, 51.3, 56.1, 108/56.3

[56] References Cited

U.S. PATENT DOCUMENTS

| | | | |
|---|---|---|---|
| 2,444,183 | 6/1948 | Cahners . | |
| 2,494,730 | 1/1950 | Thursby . | |
| 2,576,715 | 11/1951 | Farrell . | |
| 2,996,276 | 8/1961 | Sorensen et al. . | |
| 3,012,747 | 12/1961 | Greene . | |
| 3,026,015 | 3/1962 | Severn . | |
| 3,026,078 | 3/1962 | Simkins . | |
| 3,113,532 | 12/1963 | White . | |
| 3,131,656 | 5/1964 | Houle . | |
| 3,302,593 | 2/1967 | Roberts . | |
| 3,434,435 | 3/1969 | Achermann et al. . | |
| 3,464,371 | 9/1969 | Gifford . | |
| 3,477,395 | 1/1969 | Brown et al. . | |
| 3,587,479 | 6/1971 | Geschwender | 108/51.3 |
| 3,638,822 | 8/1972 | Roberts et al. . | |
| 3,659,435 | 5/1972 | Childs . | |
| 3,666,165 | 5/1972 | Osborne et al. . | |
| 3,911,834 | 10/1975 | Quaintance . | |
| 3,952,672 | 4/1976 | Gordon et al. . | |
| 4,185,565 | 1/1980 | Nymoen . | |
| 4,714,026 | 12/1987 | Yamaguchi et al. . | |
| 4,841,879 | 6/1989 | Ferguson | 108/561 |
| 4,863,024 | 9/1989 | Booth . | |
| 4,867,074 | 9/1989 | Quassnick . | |
| 4,875,419 | 10/1989 | Helton et al. . | |
| 4,936,229 | 6/1990 | Parnell . | |
| 4,966,084 | 10/1990 | Motomaru . | |
| 4,979,446 | 12/1990 | Wineberger . | |
| 4,986,418 | 1/1991 | Gwathmay | 108/51.3 X |
| 5,076,176 | 12/1991 | Clason | 108/51.3 |
| 5,176,090 | 1/1993 | Roberts et al. | 108/51.3 |
| 5,184,558 | 2/1993 | Wozniacki | 108/51.3 |

FOREIGN PATENT DOCUMENTS

| | | | |
|---|---|---|---|
| 996516 | 6/1965 | United Kingdom | 108/51.3 |
| 1498808 | 3/1968 | United Kingdom . | |
| 1106880 | 1/1978 | United Kingdom . | |

*Primary Examiner*—Jose V. Chen

*Attorney, Agent, or Firm*—Banner, Birch, McKie & Beckett

[57] ABSTRACT

A corrugated pallet construction wherein first and second blanks are used to form first and second intersecting runners respectively, by folding adjacent panels against each other in accordion-like manner. The runners are assembled in an intersecting grid pattern. The assembled runners are wrapped with two identical additional blanks to form a multilayer upper platform, sidewalls, and a lower surface portion allowing for use of a floor jack to elevate the pallet.

31 Claims, 7 Drawing Sheets

SHEET MATERIAL PALLET WITH WRAP AROUND DECK

CROSS-REFERENCES TO RELATED APPLICATIONS

This application is a continuation in part of application Ser. No. 07/772,661, filed Oct. 7, 1991 now U.S. Pat. No. 5,337,679.

BACKGROUND OF THE INVENTION

The present invention relates to pallets, and in particular sheet material pallets for transporting and storing items.

Pallets and platforms for bulk storage and transportation of materials constitute a multi-billion dollar industry. Their use is pervasive in a myriad of commercial applications, e.g., for the storage of raw and finished products in manufacturing facilities, for the transportation of finished products and materials from manufacturing facilities to distributors and retail outlets, and for storing finished materials in warehousing and retail facilities. Pallets are extremely useful for storing and transporting material since they provide an elevated support platform which protects the stored goods from spilled materials, etc. and allow conventional equipment such as a forklift to readily move large quantities of materials stored on the pallet.

Pallets are typically constructed of wood slats. Such pallets are suitable for a number of applications, especially where very heavy loads are encountered. However, wood pallets are heavy and not easily disposable or recyclable. Certain industries, such as the food industry, are extremely interested in replacing wood pallets with light weight and easily disposable/recyclable pallets, so long as such pallets can meet certain strength and durability requirements.

As an alternative to wooden pallets, pallets have been constructed of sheet material such as corrugated board material, e.g., corrugated paperboard and the like. Existing pallet constructed of sheet material have met with only limited success due to the drawbacks of limited strength and durability. Furthermore, only limited cost savings have been achieved in existing sheet material pallets due to the complexity of manufacture and assembly arising out of the multiple blanks and other pieces required to make a complete pallet. The following patents exemplify existing pallets constructed of sheet material.

Yamaguchi et al., U.S. Pat. No. 4,714,026, discloses a pallet including a deck board made from laminated corrugated fiberboard. Each of the legs is formed by a square-tubular frame made of corrugated fiberboard in which a pad or pads of plastic resin is/are inserted.

Nymoen, U.S. Pat. No. 4,185,565, discloses a two-piece corrugated pallet formed a base member and a platform member of corrugated board material. The base piece is formed by three parallel spaced channel sections connected by platform reinforcing portions. The platform member is secured to the base piece.

Winebarger, U.S. Pat. No. 4,979,446, discloses a corrugated pallet formed from interconnected base and deck members constructed from creased and scored rectangular blanks to comprise a solid core of adjacent vertically oriented panels surrounded by an outer covering of perimetric horizontally and vertically running panels. Once the base members are assembled using a U-shaped slot arrangement, a separate deck board is attached thereto.

Osborne et al., U.S. Pat. No. 3,666,165, discloses a pallet having four-way fork entry capability. Tubular members are inserted into a folded sheet of corrugated material to form the runners. A separate panel is required to form the deck.

Quaintance, U.S. Pat. No. 3,911,834, discloses a pallet made of foldable materials having four-way fork entry capability. A plurality of runners are formed integrally from a blank forming the deck and take the form of hollow elongated channels.

Farrell, U.S. Pat. No. 2,576,715, discloses a fiber board material pallet having a wrap-around upper and lower deck formed of an unitary sheet of material. It is disclosed that the wrap sections may completely overlap to form a top wall of double thickness.

None of these aforementioned patents, however, satisfactorily meet the present need for a sheet material pallet for use with a variety of material handling equipment, which provides acceptable four way entry for both fork-lift and pallet jack handling, which possesses enhanced stacking strength, heavy static load bearing ability and improved stability, yet remains simple enough in design for efficient manufacture and assembly.

SUMMARY OF THE INVENTION

The present invention discloses two embodiments of a corrugated pallet assembly. Each embodiment comprises two basic components—runners and deck pieces. The deck pieces wrap around the runners (also referred to as supports or stringers) to form the pallet of the present invention.

In each embodiment, there are two types of runners used in the present invention, and two deck pieces. First and second intersecting runners are formed by first and second blanks respectively. The runners are formed by folding adjacent panels of the blanks against each other in an accordion-like manner. Once the runners are assembled, they are connected in an intersecting grid pattern. The runners are then wrapped with two identical additional blanks (the deck pieces) to form a multilayer upper platform, sidewalls, and a lower platform. The sidewalls and lower platform preferably have cutout portions allowing for use of a floor jack to elevate the pallet.

Preferably, the runners consist of a die cut corrugated sheet of individual panels that are fan-folded or accordion-folded together to form a runner. The number of panels is dependent upon stacking strength and pallet rigidity required. The corrugated material used may be of any basis weight or construction, i.e., singlewall, doublewall, triplewall, etc. Moreover, special materials and coatings, such as moisture resistant, pest prevention, or non-skid coatings may readily be incorporated into the structure.

Both the first and second runners are manufactured and assembled in similar fashion. However, in the preferred form of the invention the first runners are longer than the second runners. The individual adjacent panels of the runners preferably are attached to each other by means of a series of slits and reverse slits. Panels may also be attached to each other by means of slits and hinge scores or notches. Various other means common to the art of corrugated design to hold the panel together for assembly may be used, such as slits and notches. All cut lines of features that separate the individual panels preferably are perpendicular to the direction of the corrugated flute lines.

The runner panels are preferably laminated to each other with adhesive. Adhesive may be applied by mechanical or manual means. The purpose of the adhesive is to bond adjacent panels together for stack strength enhancement and insure the individual panels work together as a whole. Panels may be assembled into a runner without application of adhesive, however this will likely lessen the performance of the runner. The runners are preferably notched for assembly of the first to the second runners to form an interlocking pattern. The first runners are parallel to each other and the second runners are perpendicular to the first to define a grid. Placement and spacing of one runner to another or the number of runners used can be dependent on specific use, customer need, or the convention of equal distancing of runners to distribute load bearing stress uniformly over the surface of the pallet. Assembly of the first and second runners into a pattern can be accomplished by automated or manual means.

Openings may be formed in both the first and second runners to facilitate the use of lift truck forks for movement of the pallet. Shape, size and positioning of the openings generally is dependent upon the customers requirements and the type of equipment used in the material handling environment. The present invention lends itself to either two or four-way entry runner construction.

In the first embodiment, the deck pieces preferably consist of two identical die-cut pieces of corrugated board which are wrapped around the runners to form the top and bottom platform or deck of the pallet and the sidewalls. The deck pieces are scored to define a top deck portion, a sidewall portion, and a bottom deck portion. The deck pieces are wrapped around the runners so that the top deck portions of each deck piece overlap and are preferably laminated together with adhesive to form a very rigid and solid deck surface.

The bottom deck portions do not overlap, in the preferred form of the first embodiment of the invention. They abut to form a single layer bottom deck. The sidewall portions of the deck pieces form vertical sidewalls which preferably parallel the direction of the first runners. The sidewalls include cut-outs which provide fork entry positions for certain material handling purposes. Preferably, the cut-out includes a tuck flap portion which folds inwardly and is glued to the bottom portion of the adjacent runner. The tuck flap adds rigidity to the pallet and provides guidance of the lifting forks into the pallet.

The sidewall cut-outs preferably extend into the bottom deck portion of the deck piece in such fashion and placement to allow the use of floor jacks. Floor jacks are material handling devices with wheels positioned under the lifting forks. Hence, a solid bottom deck would preclude the use of floor jacks.

Assembly of the deck pieces to the runners is effected by applying adhesive to all contact surfaces of the assembled runners, both in the vertical and horizontal planes that contact with the deck pieces. Once adhesive is applied to the runners, then the deck piece is folded around the runners, the entire assembly is put into compression, and the adhesive is allowed to set-up. Conversely, adhesive can be applied to the deck pieces at all runner contact points and put into compression.

The first and second runners have mutually cooperating first apertures for interlocking together in a grid-like pattern. The runners further have second apertures, positioned in cooperation with the cut-out regions of the deck pieces, for floor jack and/or forklift access. The runners may also have additional fork lift apertures to provide four-way entry for a fork lift.

Rather than erecting a full bottom deck with cut-outs, the second embodiment of the invention provides the top deck with legs that extend down and around the runners and tuck into a slot provided by an intersection of the runners. The legs can be fixed to the slot either by friction locking it into place or it may be glued, stitched or stapled for added reliability.

The preferred form of the second embodiment also differs from the preferred form of the first in that the interlocking slots of the longitudinal and lateral runners have been reversed. The width of long runners' slots adjacent its ends has been increased to accommodate the deck leg and a short runner.

Additionally, the design of the longitudinal runners in the second embodiment differs from the longitudinal runners in the first embodiment. The longitudinal runners of the second embodiment are shaped so that the second and fourth lateral runners act as a guide for the lifting forks of a fork truck or pallet jack device.

It is to be understood that both the foregoing general description and the following detailed description are exemplary only and are not restrictive of the invention, as claimed.

BRIEF DESCRIPTION OF THE DRAWINGS

The accompanying drawings, which are incorporated in and constitute a part of the specification, illustrate an example of a preferred embodiment of the invention and together with the description serve to explain the principles of the invention.

DETAILED DESCRIPTION

Reference will now be made in detail to the presently preferred embodiments of the invention examples of which are illustrated in the accompanying drawings.

Figure 1:
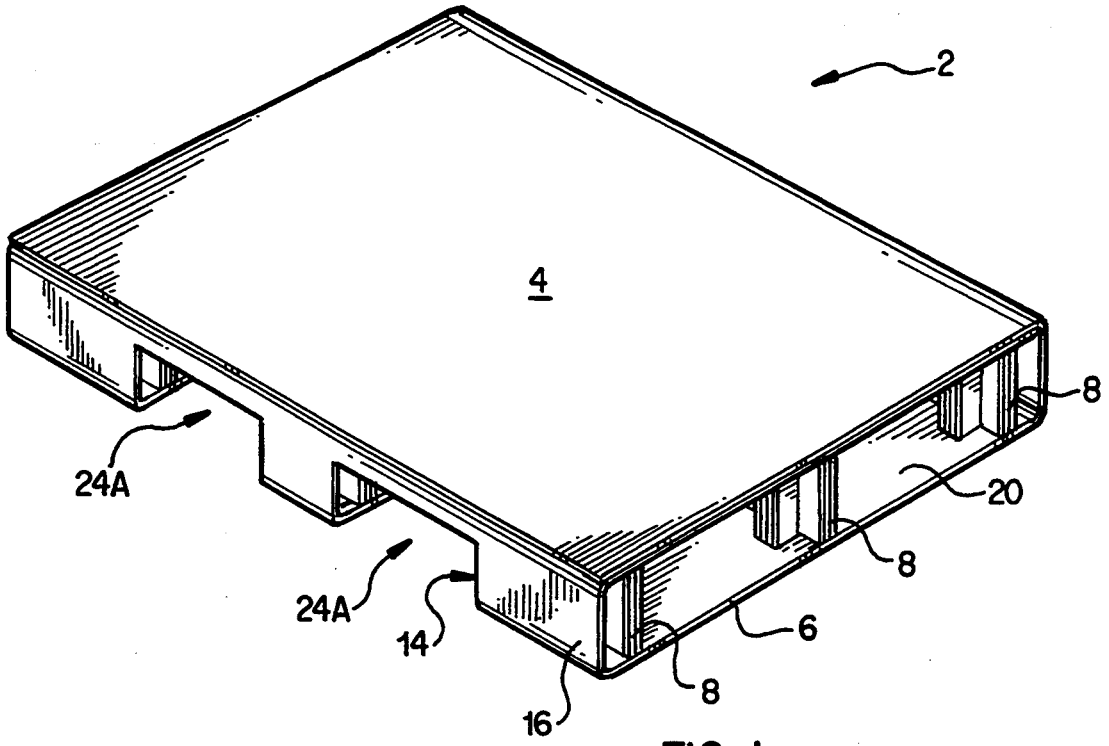
FIG. 1, shows a perspective view of the top surface of the first embodiment of the pallet of the present invention.
Figure 2:
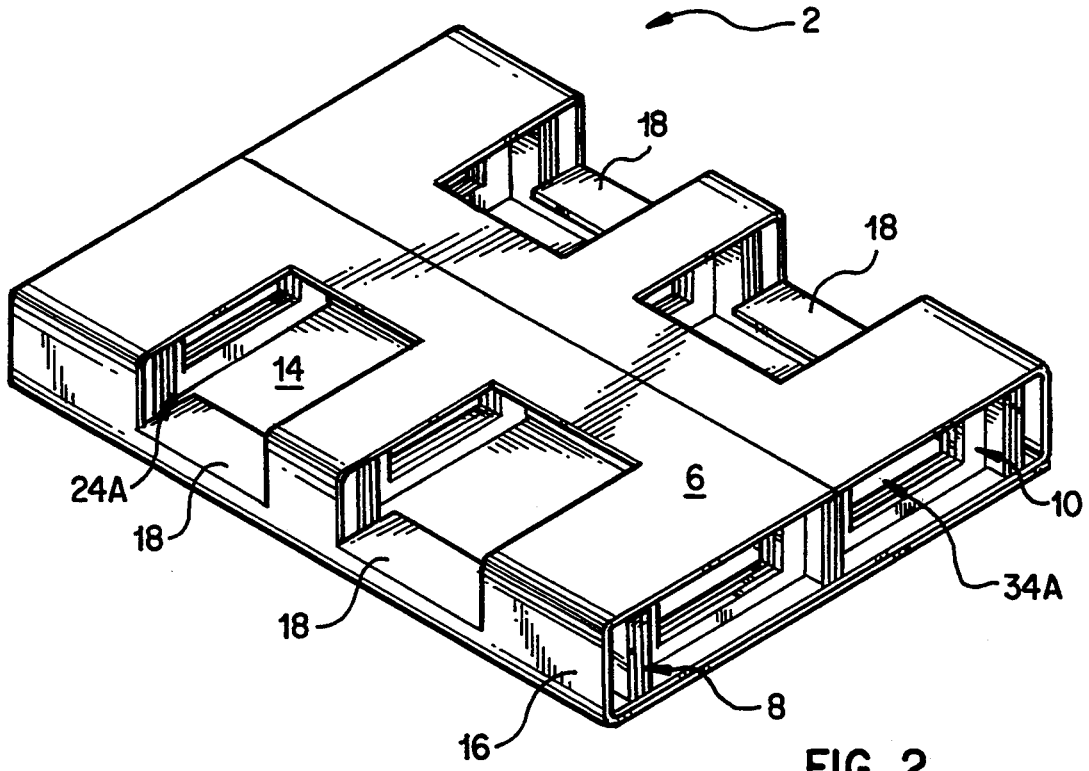
FIG. 2, shows a perspective view of the bottom surface of the pallet of FIG. 1.
Figure 3:
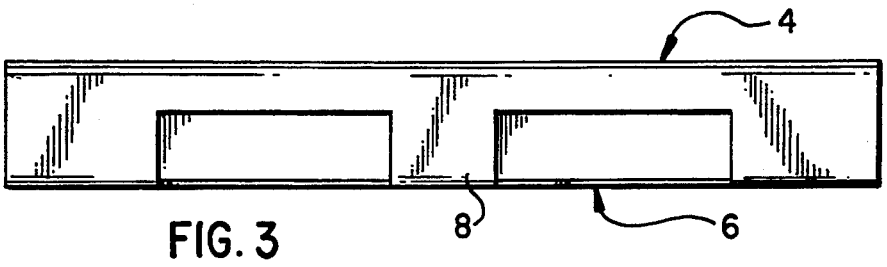
FIG. 3, shows a longitudinal side view of the pallet of FIG. 1.

In accordance with the first embodiment of present invention, shown generally in FIGS. 1 and 2, a corrugated pallet assembly 2 is provided including an upper deck panel 4 and a lower deck panel 6. Pallet 2 may be made from conventional corrugated container board, e.g., corrugated paper board, or synthetic corrugated material such as extruded low density polyethylene material. Other materials or coatings may be used for specific performance requirements, as is well-known in the art. Additionally, solid fiber board may constitute a suitable material depending on the particular pallet application. Corrugated paperboard is generally preferred for its relatively low cost, high strength and disposability/recyclability.

In accordance with the first embodiment of the present invention, the corrugated panel assembly is provided with longitudinally-extending runners 8 and laterally-extending runners 10 located between upper deck panel 4 and lower deck panel 6. The longitudinally-extending and the laterally-extending runners intersect one another in a grid-like pattern, described subsequently in greater detail, for enhanced structural integrity.

Figure 5:
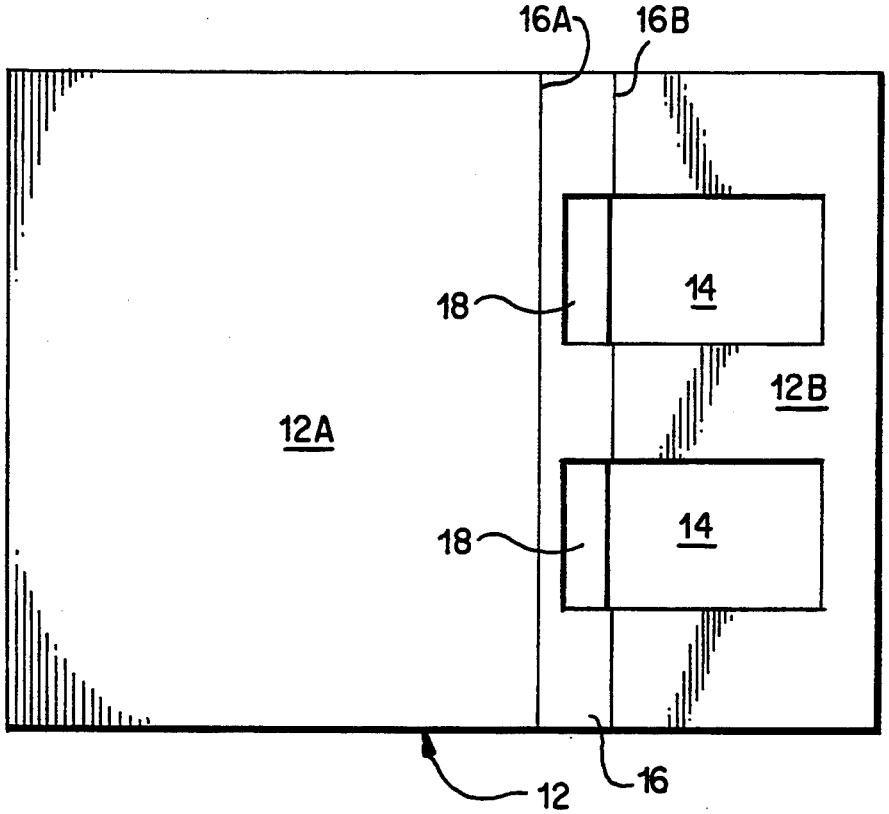
FIG. 5, shows a plan view of the first and second blanks, in flat condition, of the first embodiment of the present invention.
Figure 6:
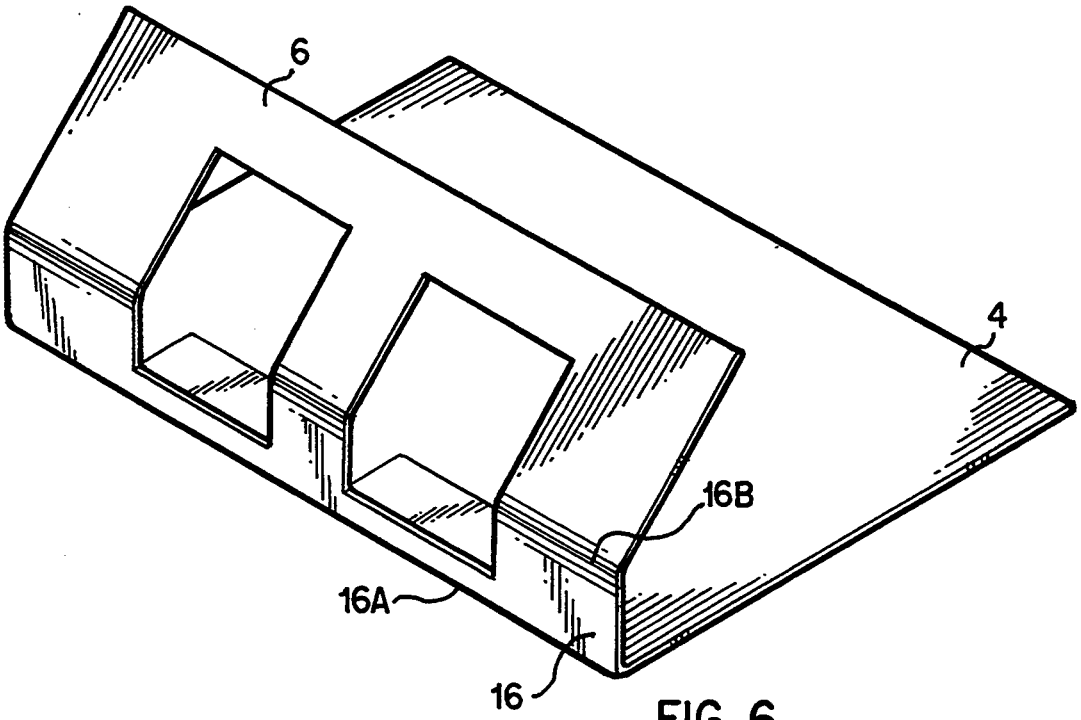
FIG. 6, shows a perspective view of the first and second blanks, for constructing the wrap around upper and lower decks, in semi-folded condition of the first embodiment of the present invention.

In accordance with the first embodiment of the present invention, as illustrated in FIGS. 5 and 6, the upper and lower deck preferably are formed of two similarly shaped and sized deck pieces 12. These deck pieces 12 include a first or top deck portion 12A, bottom deck portion 12B, and a sidewall portion 16. Deck pieces 12 have two spaced part openings 14 which extend from the sidewall portion into the bottom deck portion. FIG. 6 shows a single sheet of material 12 in semi-folded condition as it forms the upper deck, sidewall, and lower deck. During assembly, two deck pieces 12 are combined to form the assembled pallet.

Specifically, in accordance with a preferred form of the first embodiment of the present invention, the two deck pieces 12 so that are each wrapped around the runners the two top deck portions 12A to form a double thickness top deck. Deck piece 12 is folded about lines 16A and 16B to create longitudinal sidewall 16 and a single thickness bottom deck. The edges of bottom deck portion 12B of each deck piece abut to form the single layer bottom deck.

Figure 4:
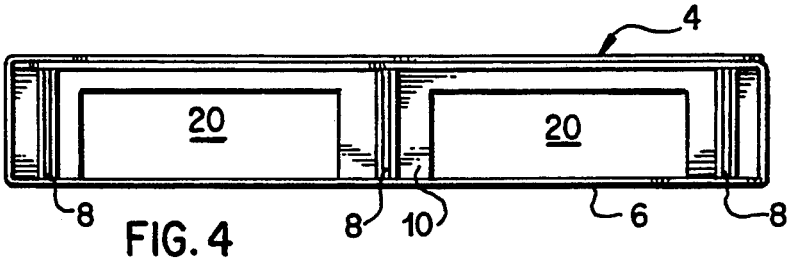
FIG. 4, shows a lateral or transverse side view of the pallet of FIG. 1.

The pallet has substantially open opposing lateral sides 20 (as shown in FIG. 4). Openings 14 extending from sidewall 16 to a predetermined distance into the lower deck. As a result, floorjack and forklift material handling equipment access is provided by the present invention.

In a preferred embodiment, a plurality of tuck flaps 18 are cut from sidewalls 16 in the area of the spaced apart openings 14. Tuck flaps 18 are positioned so as to provide guidance for floorjack and forklift entry. Preferably, tuck flaps 18 are folded inwardly of the pallet as shown in FIG. 2 and affixed in a conventional manner to a longitudinally-extended runner positioned on the outside edges of the pallet.

The present invention connects longitudinally-extending runners 8 to laterally-extending runners 10 to form a grid-like pattern about which the two deck pieces 12 are wrapped.

Figure 9:
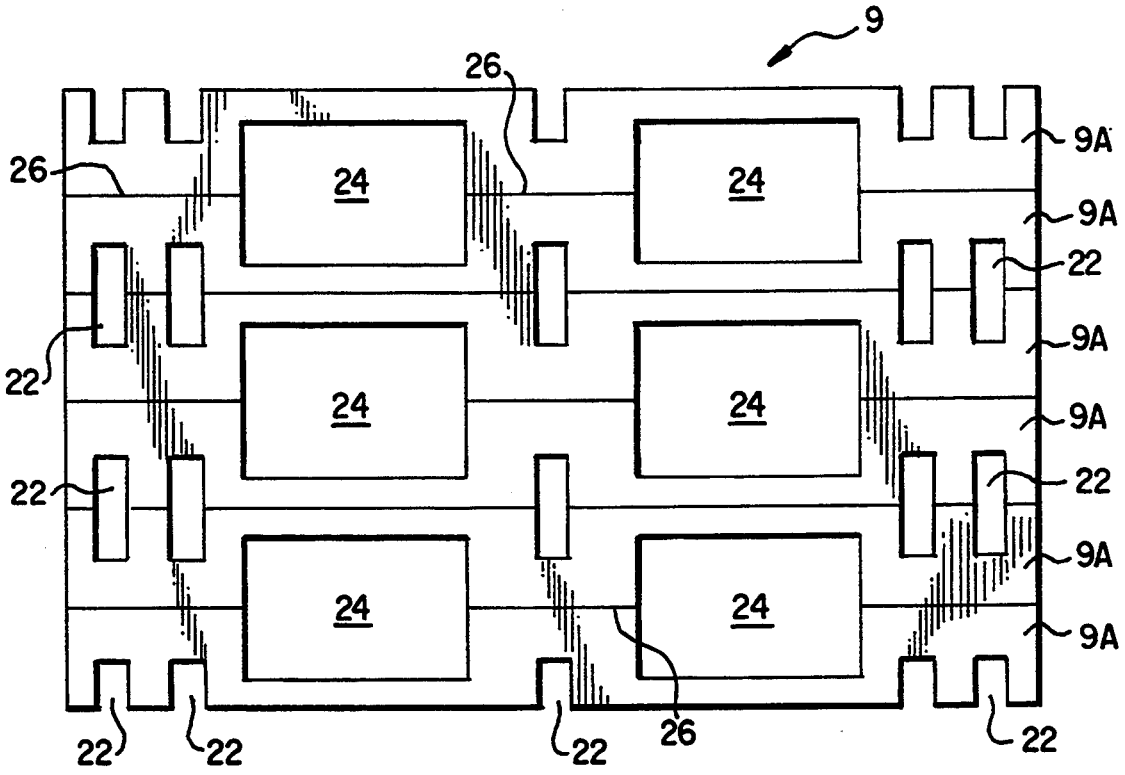
FIG. 9, shows a plan view for the blank for the second longitudinally-extending runner, in flat condition, of the first embodiment present invention.
Figure 10:
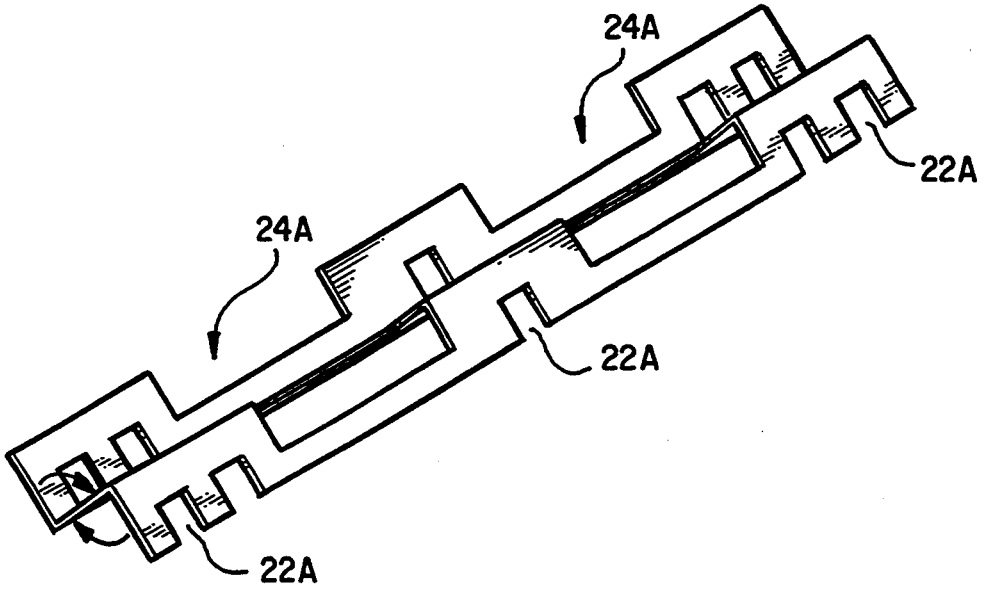
FIG. 10, shows a perspective view of the blank for the second longitudinally-extending runner, in semi-folded condition, of the first embodiment present invention.

In accordance with the present invention, FIG. 9 depicts a plan view of the corrugated sheet 9 used to create the longitudinally-extending runner 8. Sheet 9 includes a plurality of panels 9A, a plurality of first apertures 22 and a plurality second apertures 24. The apertures in the panels preferably are U-shaped. Sheet 9 is fan-folded along fold lines or slits 26 as shown in FIG. 10 to create a multi-layered construction.

When so folded the first and second apertures overlap to define a plurality of U-shaped notches 22A and 24A, respectively. Notches 24A and 22A open on opposite sides of runners 8.

Figure 7:
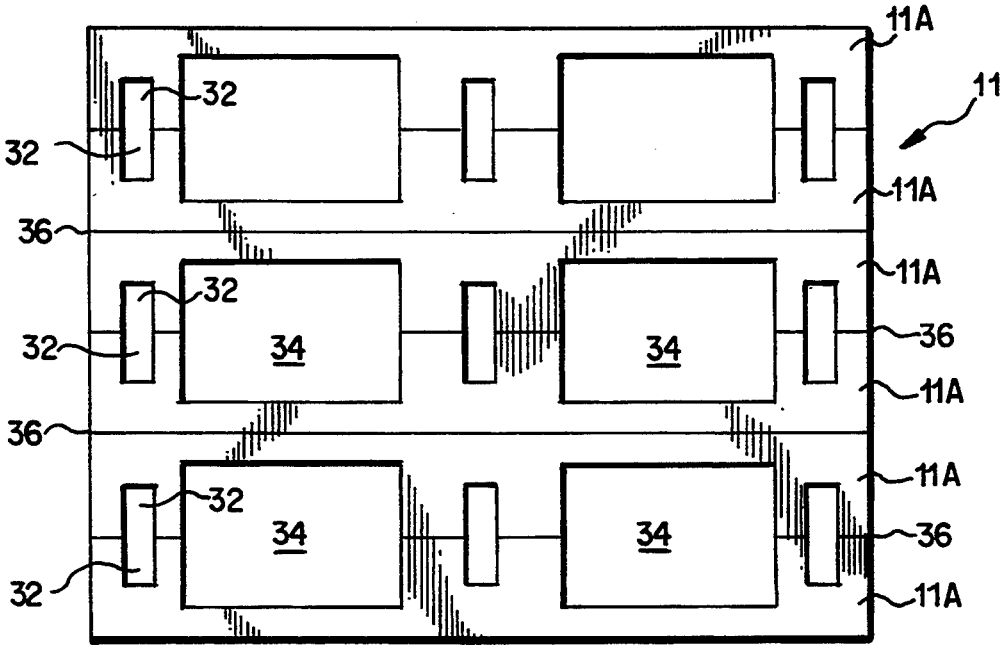
FIG. 7, shows a plan view of the blank for the laterally-extending runner, in flat condition, of the first embodiment present invention.
Figure 8:
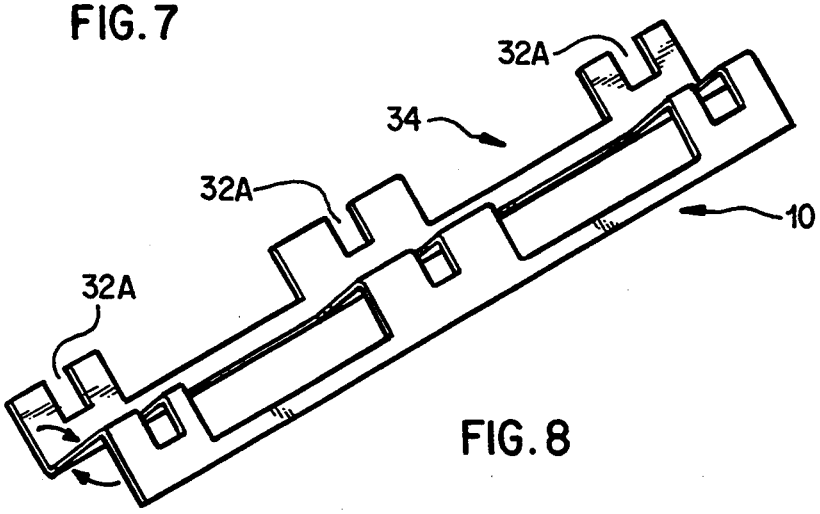
FIG. 8, shows a perspective view of the blank for the laterally-extending runner, in semi-folded condition, of the first embodiment present invention.

Similarly, the present invention contemplates that the laterally-extending runners 10 are constructed from a corrugated sheet 11 as shown in FIGS. 7 and 8. Sheet 11 includes a plurality of panels 11A, a plurality of first apertures 32 and a plurality of second apertures 34. Again, the apertures are preferably U-shaped. Sheet 11 is fan-folded along fold to create a multi-layered construction along fold lines or slits 36 so that first apertures 32 overlap each other and second apertures 34 overlap one another to create notches 32A and 34A, respectively.

The U-shaped notches 22A of the longitudinally-extending runners 8 and the U-shaped notches 32A of the laterally-extending runners 10 interlock when the runners are assembled into a grid.

U-shaped notches 24A of runners 8 are positioned in cooperation with the openings 14 of the two corrugated sheets 12 for floorjack and forklift access. Additionally, the laterally-extending runners 10 are positioned so that the U-shaped notch 34A provides forklift access from the ends of the pallet, i.e., in the direction parallel to the sidewalls 16.

The number of panels 9A, 11A forming each runner, and thus the thickness and strength of each runner, can be easily varied in accordance with the required load bearing strength of the pallet.

Adjacent panels 9A, 11A of the runners which are to be folded against each other may be attached by a simple notch-type hinge, a hinge score, or other commonly used structures, as described in applicant's parent application, Ser. No. 07/722,661. Other suitable hinging techniques will be apparent to those skilled in the art.

The preferred hinging method will depend, in part, upon the equipment available for creating the blanks. If the available equipment does not easily allow for slit scoring from either side of the material, this technique may not be desirable. Runner-forming panels 9A and 11A are preferably folded in an accordion-like manner. Thus, the directions of the folds will alternate from one panel edge to the next. If slit scoring is used, it is necessary to provide these slit scores from opposite sides of the material in order to allow for folding in the required direction without material binding. Notches have the advantages of bi-directional folding thus avoiding the need to provide cutting from opposite sides of the material. Depending on the available equipment, notches may or may not be easier to provide than slit score hinges. Hinge scores are not as simply provided as notch-tape hinges. However, hinge scores better facilitate the bi-directional folding required of runner-forming panels 9A and 11A as compared with notches. Simple score lines are simple and inexpensive to provide. However, folding about a score line is generally not as easy as folding about hinge lines created utilizing the other methods.

It is preferable that the corrugation direction of each blank be perpendicular to the hinge lines of the respective panels. In this manner, greater structural integrity at the hinge points is maintained.

In accordance with the second embodiment of the present invention, as illustrated in FIGS. 11–18, a similar grid is formed from longitudinally extending runners 80 and laterally extending runners 72 which interfit within each other. Each runner is formed identically to the runners in the first embodiment.

Figure 16:
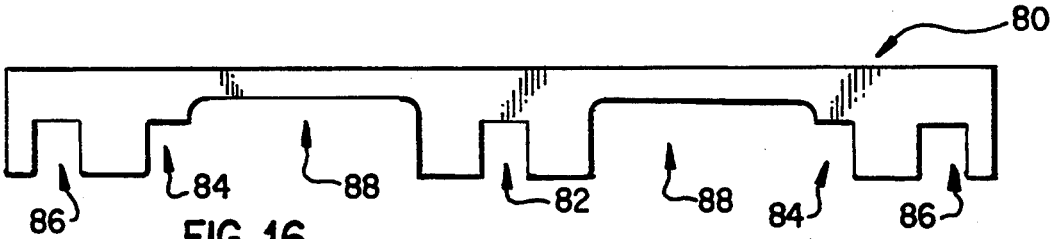
FIG. 16, shows a side view of a longitudinally extending runner of the second embodiment of the present invention.
Figure 17:
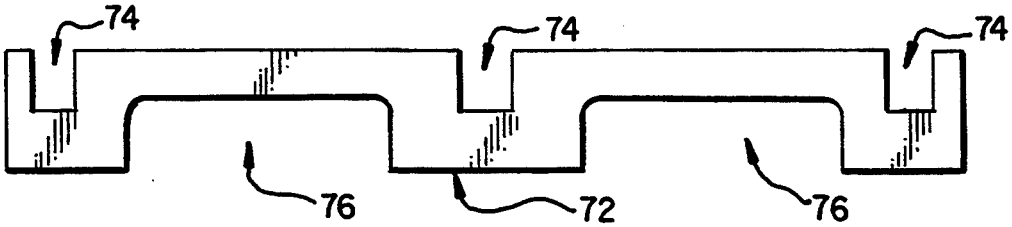
FIG. 17, shows a side view of a laterally extending runner of the second embodiment of the present invention.

As illustrated in FIG. 17, laterally extending runner 72 includes three slots 74 formed in its upper surface and two slots 76 formed in its lower surface. As illustrated in FIG. 16, longitudinally extending runner 80 includes three slots 82, 84, 86 formed in its lower surface to interfit with the three slots 74 in the upper surface of the laterally extending runner. The end slots 86 are slightly larger than the other slots 82, 84 for a purpose to be described hereinafter. Longitudinally extending runner 80 includes two additional slots 88 formed in its lower surface. These slots 88 along with the lower slots in the laterally extending runner create an access for a fork or a similar lifting tool to fit thereunder.

Figure 11:
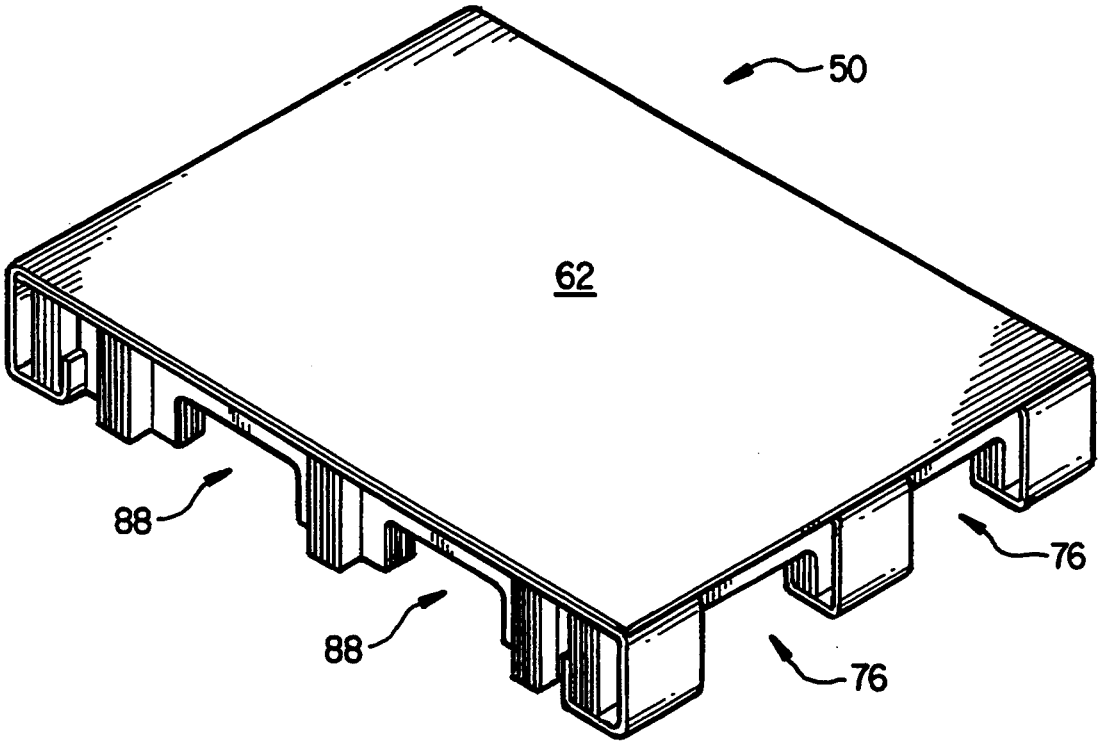
FIG. 11, shows a perspective view of the top surface of the second embodiment of the pallet of the present invention.
Figure 12:
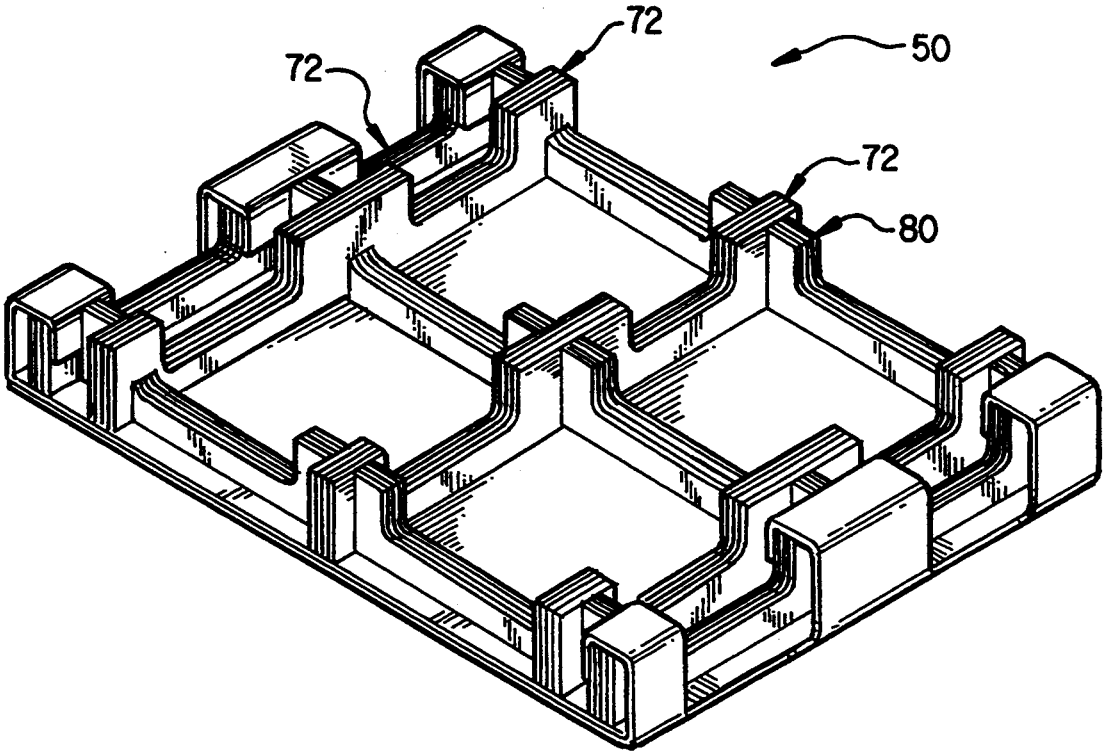
FIG. 12, shows a perspective view of the bottom surface of the pallet of FIG. 11.
Figure 13:
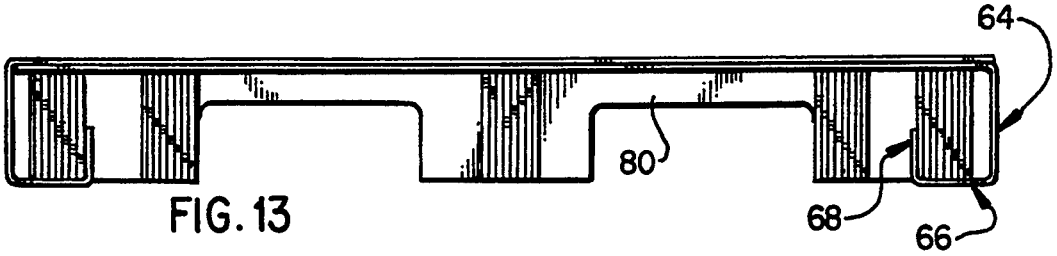
FIG. 13, shows a longitudinal side view of the pallet of FIG. 11.
Figure 14:
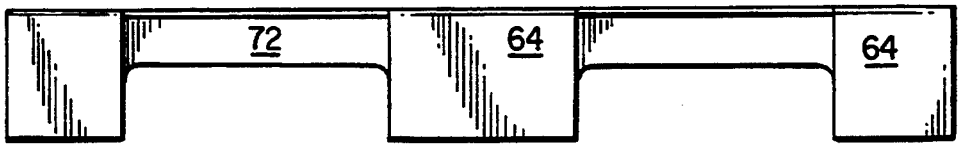
FIG. 14, shows a lateral or transverse side view of the pallet of FIG. 11.
Figure 18:
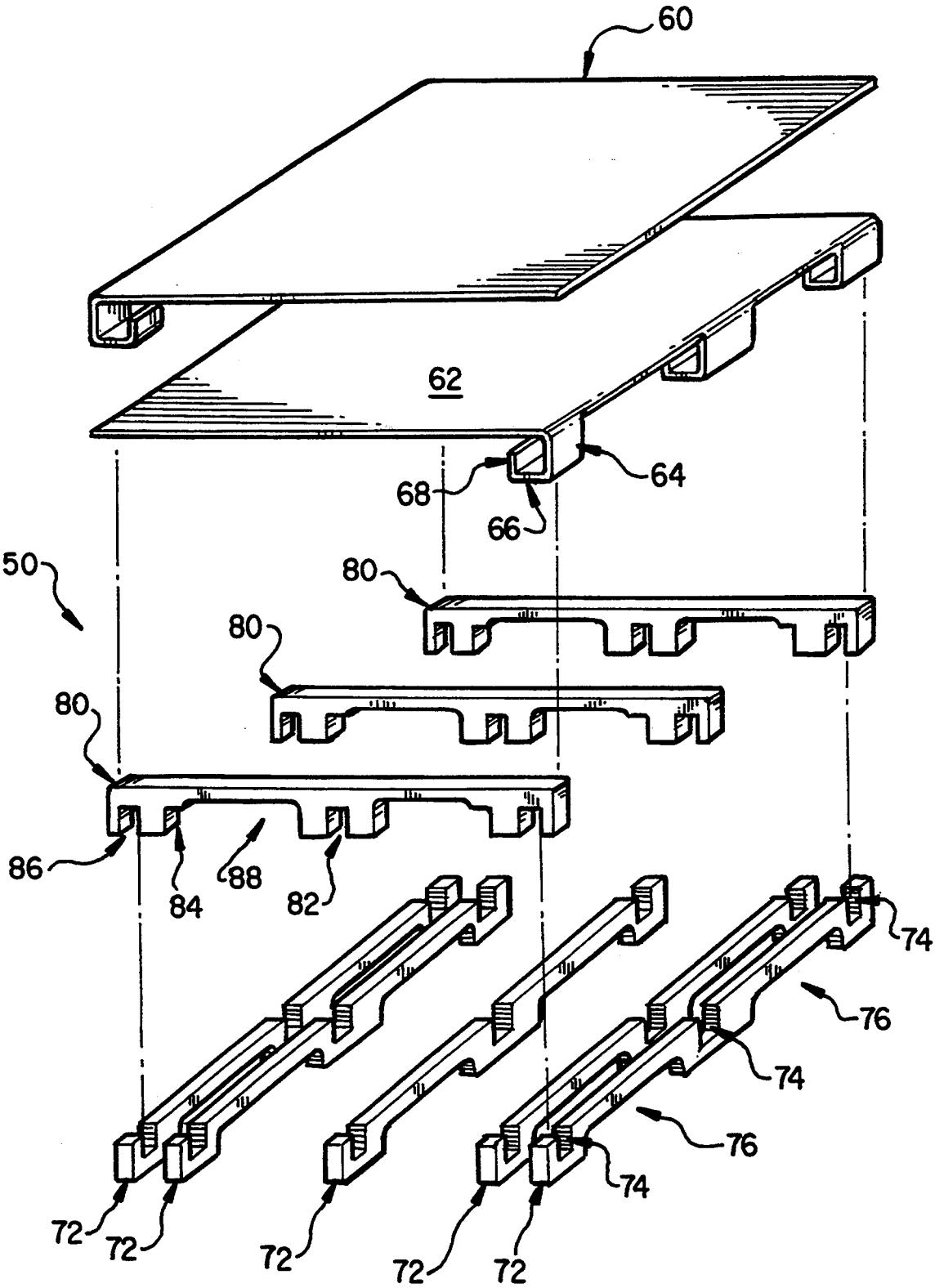
FIG. 18, shows a exploded of the pallet of the second embodiment of the present invention.

As shown in FIGS. 11, 12, and 18, there are five laterally extending runners 72 and three longitudinally extending runners 80. All laterally extending runners are identical and all longitudinally extending runners are identical.

Figure 15:
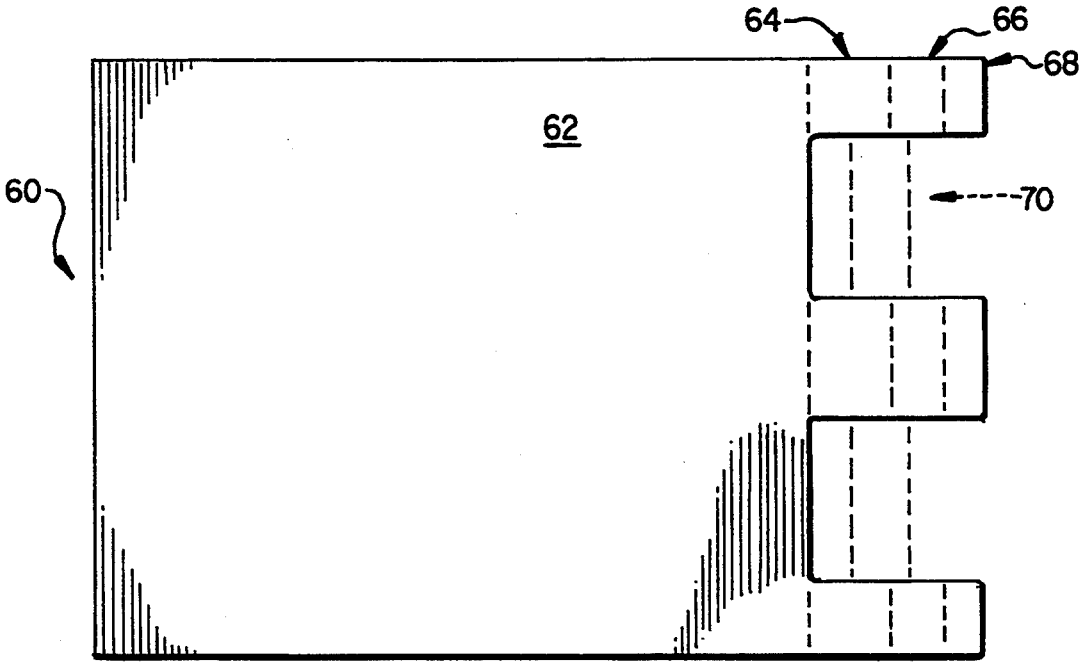
FIG. 15, shows a plan view of the first and second blanks, in flat condition, of the second embodiment of the present invention.

Two deck pieces 60 fit over and around the grid of runners and are oriented 180° from each other. As best shown in FIG. 15, these deck pieces 60 include a platform surface 62, a sidewall surface 64, a bottom surface portion 66, and lock tab or flaps 68. For additional strength, tuck flaps 70 may be added which are folded and affixed to the upper surface of the slots 76 formed in the lower surface of the laterally extending runners 72.

The second embodiment has the same advantages as the first embodiment. However, the second embodiment also includes two additional advantages.

First, the second embodiment provides for a stronger connection between the deck pieces 60 and the grid of runners 72, 80. This stronger connection is created by the lock flaps 68 and the widened slots 86. The two laterally extending runners 72 on the end fit into the widened slots 86. The slots 86 are sized to fit the width of the laterally extending runner 72 and the thickness of the lock flap 68 on the deck piece 60. The lock flaps 68 are tucked into the extended width slots 86 inward of the end laterally extending runners 72. The lock flap 68 can be either friction locked into place or for added reliability it can be glued, stitched, or stapled into place.

Secondly, the arrangement in the second embodiment provides for excellent runner protection. The slots 84 on the longitudinally extending runners are positioned such that the second and fourth laterally extending runners 72 bound fork entry slots 88 on their outer wall surface. Thus, the second and fourth laterally extending runners 72 act as a guide for the lifting forks of a fork lift truck or a pallet jack device. The guide protects the runners by giving the fork a planar surface against which to slide.

Another difference between the preferred form of the embodiments is that the interlocking of the long (longitudinally extending runners) and the short (laterally extending runners) have been reversed. This arrangement, although preferred, is not required and the pallets may be designed with either interlocking scheme.

The manufacture of the parts of the pallet of the second embodiment is essentially the same to that of the first embodiment.

Preferably, in order to assemble the pallet of the present invention, adhesive is used to adhere each deck piece to the surfaces of each of the runners contacted by the deck pieces. Suitable adhesive compositions will be apparent to those skilled in the art, and will depend upon the chosen pallet material as well as other factors. Additionally, other known means may be utilized for securing the respective pieces together, separately or in combination with adhesives, including stitching and stapling.

As an advantage in both embodiments, the use of vertically oriented adjacent panels of corrugated material for forming the pallet runners facilitates pallet assembly and allows the thickness (and hence the strength) of the runners to be easily varied. Also, any exposed corrugation flutes along the bottom edge surfaces of the runners may serve as convenient places to apply a moisture resistant composition. Such a moisture resistant composition is desirable in order to inhibit the migration of moisture/water from the floor surface to the pallet to thereby enhance the retention of pallet stacking strength and stability. Suitable coatings, which are widely known and commercially available, include wax based compositions, resin-type compositions and water soluble silicone based solutions. Application methods may include hot/cold roller coating, dipping and spraying.

Other embodiments of the invention will be apparent to those skilled in the art in consideration of the specification and practice of the invention disclosed herein. It is intended that the specification and examples be considered exemplary only, with the scope of the invention being defined by the following claims.

I claim:

1. A pallet having a top, a bottom and four sides, said pallet formed of sheet material and comprising:

a plurality of spaced lateral runners oriented substantially parallel to each other, each said lateral runner having an upper and lower surface and including a plurality of first slots in one of said upper or lower surfaces;

a plurality of spaced longitudinal runners oriented substantially parallel to each other and oriented substantially perpendicular to said lateral runners, each said longitudinal runner having an upper and lower surface and including a plurality of first slots in the other one of said upper and lower surfaces from said first slots in said lateral runners;

said first slots of said longitudinal and lateral runners interfit to provide a lattice grid structure; and platform means comprising an upper planar surface portion, a plurality of sidewall portions, and a bottom surface portion, said lattice grid structure bounded from above by said upper surface portion, at least part of said lattice grid structure bounded on a plurality of sides by said plurality of sidewall portions, and at least part of said lattice grid structure bounded from below by said bottom surface portion.

2. The pallet as claimed in claim 1, wherein said longitudinal and lateral runners are formed by accordion folded corrugated cardboard.

3. The pallet as claimed in claim 1, wherein each lateral runner, each longitudinal runner, and said platform means is corrugated cardboard.

4. The pallet as claimed in claim 1, wherein each said lateral runner further includes a plurality of second slots in said bottom surface between two of said longitudinal runners for the entrance of a lifting element therein.

5. The pallet as claimed in claim 4, wherein each said longitudinal runner further includes a plurality of second slots in said lower surface between two of said lateral runners for the entrance of a lifting element therein.

6. The pallet as claimed in claim 1, wherein each said longitudinal runner further includes a plurality of second slots in said lower surface between two of said lateral runners for the entrance of a lifting element therein.

7. The pallet as claimed in claim 6, wherein two of said lateral runners provide a planar side guide surface for the entrance of said lifting element within said second slots, and provide for increased runner protection from damage.

8. The pallet as claimed in claim 1, further comprising five lateral runners and three longitudinal runners.

9. The pallet as claimed in claim 1, wherein said platform means comprises two platform members, each platform member comprising an upper planar surface, at least one sidewall surface, and at least one bottom surface portion, said platform members being oriented at 180° to each other, and wherein the upper planar surface of one platform member substantially overlaps the upper planar surface of the other platform member, and the sidewall portions of each platform member are located on opposite sides of the pallet.

10. The pallet as claimed in claim 9, wherein said bottom surface portions of said platform members do not overlap.

11. The pallet as claimed in claim 10, wherein said bottom surface portions of said platform members abut one another to form a lower deck.

12. The pallet as claimed in claim 11, wherein the bottom surface portions of each said platform member include apertures, and said pallet further including pockets defined by the space created by said apertures for the entrance of a lifting element therein.

13. The pallet as claimed in claim 9, wherein each platform member further includes a lock flap adjacent said bottom surface portion which extends over one of said runners and is inserted into one of said first slots to retain said platform member to said lattice grid structure.

14. The pallet as claimed in claim 13, wherein said tab portion is inserted into said one of the first slots between a vertical wall of said one of the first slots and a side surface of the runner which said tab portion extends over.

15. The pallet as claimed in claim 1, wherein said platform means further includes a lock flap adjacent said bottom surface portion which extends over one of said runners and is inserted into one of said first slots to retain said platform means to said lattice grid structure.

16. A pallet formed of sheet material comprising:

a plurality of longitudinally spaced lateral runners oriented substantially parallel to each other, each said lateral runner having an upper and lower surface and including a plurality of first slots;

a plurality of laterally spaced longitudinal runners oriented substantially parallel to each other and oriented substantially perpendicular to said lateral runners, each said longitudinal runner having an upper and lower surface and including a plurality of first slots;

said first slots of said longitudinal and lateral runners interfit to provide a lattice grid structure; and at least one platform member comprising an upper planar surface, at least one sidewall portion, a bottom surface, and at least one lock flap, said lattice grid structure bounded from above by said upper planar surface, said at least one sidewall portion forming at least one sidewall of the pallet, part of said lattice grid structure bounded from below by said bottom surface, and said at least one lock flap being located adjacent said bottom surface portion; and whereby said at least one lock flap is inserted into one of said first slots to attach said platform member to said grid structure.

17. The pallet as claimed in claim 16, further comprising two substantially identical platform members.

18. The pallet as claimed in claim 17, wherein the upper planar surface of one platform member substantially overlaps the upper planar surface of the other platform member.

19. The pallet as claimed in claim 18, wherein said platform members are oriented 180° with respect to each other, and the sidewall formed by one platform member is at an opposite side of the pallet from the sidewall formed by the other platform member.

20. The pallet as claimed in claim 19, wherein each said longitudinal runner further comprises a pair spaced apart of second slots on their lower surface for access in a direction parallel to said lateral runners of a pallet handling device.

21. The pallet as claimed in claim 19, wherein each said lateral runner further comprises a pair spaced apart of second slots on their lower surface for access in a direction parallel to said longitudinal runners of a pallet handling device.

22. The pallet as claimed in claim 21, wherein said each said longitudinal runner further comprises a pair spaced apart of second slots on their lower surface for access in a direction parallel to said lateral runners of a pallet handling device.

23. The pallet as claimed in claim 22, wherein each said second slot in each said longitudinal runner has a vertical wall on one side and an upper horizontal wall, and is bounded on a side opposite said vertical wall by a lateral runner.

24. The pallet as claimed in claim 17, wherein each platform member further comprises a plurality of tuck flaps formed from a portion of said at least one sidewall portion, said tuck flaps being folded inwardly of the pallet and being affixed to one of said lateral runners.

25. The pallet as claimed in claim 17, wherein each of said at least one lock flap extends over one of said runners and is inserted into one of said first slots to attach said platform members to said lattice grid structure.

26. The pallet as claimed in claim 25, wherein each of said at least one lock flaps inserted in said one of the first slots is locked between a vertical wall of said one of the first slots and a side surface of the runner which said lock flap extends over.

27. A pallet having a top, a bottom and four sides, said pallet formed of sheet material and comprising:

a plurality of spaced lateral runners oriented substantially parallel to each other, each said lateral runner having an upper and lower surface and including a plurality of first slots in one of said upper or lower surfaces;

a plurality of spaced longitudinal runners oriented substantially parallel to each other and oriented substantially perpendicular to said lateral runners, each said longitudinal runner having an upper and lower surface and including a plurality of first slots in the other one of said upper and lower surfaces from said first slots in said lateral runners;

said first slots of said longitudinal and lateral runners interfit to provide a lattice grid structure; and a wrap-around deck comprising an upper planar surface portion, a plurality of sidewall portions, and a bottom surface portion, said lattice grid structure bounded from above by said upper surface portion, at least part of said lattice grid structure bounded on a plurality of sides by said plurality of sidewall portions, and at least part of said lattice grid structure bounded from below by said bottom surface portion.

28. The pallet as claimed in claim 27, wherein said wrap-around deck comprises two platform members, each platform member comprising an upper planar surface, at least one sidewall surface, and at least one bottom surface portion, said platform members being oriented at 180° to each other, and wherein the upper planar surface of one platform member substantially overlaps the upper planar surface of the other platform member, and the sidewall portions of each platform member are located on opposite sides of the pallet.

29. The pallet as claimed in claim 28 wherein said bottom surface portions of said platform members do not overlap.

30. The pallet as claimed in claim 29, wherein said bottom surface portions of said platform members abut one another to form a lower deck.

31. The pallet as claimed in claim 28, wherein each platform member further includes a tab portion adjacent said bottom surface portion which extends over one of said runners and is inserted into one of said first slots to retain said platform member to said lattice grid structure.

* * * * *